United States Patent [19]

Marrs

[11] Patent Number: 5,000,390

[45] Date of Patent: Mar. 19, 1991

[54] APPARATUS AND METHOD FOR SIZING WOOD CHIPS

[75] Inventor: Gevan Marrs, Puyallup, Wash.

[73] Assignee: Weyerhaeuser Company, Tacoma, Wash.

[21] Appl. No.: 358,682

[22] Filed: May 30, 1989

[51] Int. Cl.[5] ..... B02C 19/12

[52] U.S. Cl. ..... 241/24; 241/28; 241/81; 209/44.1; 209/234

[58] Field of Search ..... 209/234, 235, 44.1, 209/672, 629, 2, 38, 10; 241/81, 79, 68, 80, 97, 24, 75, 76, 77, 78, 28

[56] References Cited

U.S. PATENT DOCUMENTS 4,376,042 3/1983 Brown ..... 209/38

OTHER PUBLICATIONS

J. V. Hatton, Chip Quality Evaluation, *Pulp Paper Can.*, Jun. 1976, pp. T99–T103.

J. V. Hatton, Screening Mill Chips for Sizeable Savings, *Pulp Paper Can.*, Mar. 1977, pp. T57–T60.

J. V. Hatton, Screening of Pulpwood Chips for Quality and Profit, *Paper Trade Journal*, Apr. 1979, pp. 25–27.

*Primary Examiner*—Mark Rosenbaum

*Attorney, Agent, or Firm*—Graybeal, Jensen & Puntigam

[57] ABSTRACT

A wood chip sizing apparatus, based on the thickness dimension, which includes a gyratory screen system (16) comprising three separate screens (18, 22, 26) which produces a total of four fractions, one fraction (20) comprising substantially all overthick chips, another fraction (24) comprising both overthick chips and accepts, another fraction (28) comprising substantially all accepts, and another fraction (30) comprising substantially all unders. Fraction (20) is moved directly to a chip slicer (52) which reduces the size of substantially all the chips to accepts. Fraction (24) is directed to a second screening station (42) which separates fraction (24) into two further fractions (44 and 46), one of which (44) comprises overthick chips, and the other of which (46) comprises accepts. The overthick chips (fraction 44) are applied to the chip slicer (52). Fraction (30) is processed to produce products other than pulp, while fractions (28) and (44) and the chips from the chip slicer (52) are moved to storage or a digester for pulping.

13 Claims, 5 Drawing Sheets

APPARATUS AND METHOD FOR SIZING WOOD CHIPS

TECHNICAL FIELD

The present invention relates generally to the art of pulping wood chips and more particularly concerns an apparatus and method for fractionating an inflow of chips prior to the pulping thereof.

BACKGROUND OF THE INVENTION

It is well known that appropriately sized chips are quite important in the production of wood pulp. Briefly, in the pulping process, a digester, with the use of chemicals and elevated pressures and temperatures, breaks down wood chips into their constituent elements, basically lignin and cellulose (wood fibers). The cellulose is then processed to produce pulp.

Screening systems of various kinds have been used to correctly size the inflow of wood chips. Undersized chips, referred to as "fines" may be overcooked in the digester, which results in a lower pulp yield and the weakening of the pulp, while oversized (particularly overthick) chips are not broken down completely in the digester, and the remaining particles from the overthick chips must be removed at a later point from the pulp, increasing the expense of the process and reducing the overall pulp yield.

In the past, the sizing of wood chips has typically been based on the length and width dimensions of the chip, primarily width. However, the thickness dimension of the chip is currently regarded to be the most important dimensional consideration. Therefore, the chip screening process has been developed to separate chips based somewhat upon traditional length and width criteria, but primarily on thickness. Generally, for the purposes of this application, the term "sizing" will refer to the separation of chips based on thickness. The separation of chips according to size is also referred to hereinafter as fractionation, i.e. separating chip inflow into 1) chips within an acceptable predetermined size range (accepts), 2) chips which are smaller than the predetermined size range (fines), and 3) chips which are thicker than the predetermined range (overthick).

The publication of E. Christensen, in the May 1976 TAPPI Journal, Vol. 59, No. 5, discloses a chip sizing system which includes a gyratory screen in combination with a disk screen. The gyratory screen typically is a sheet member with openings therethrough of a particular size, while the disk screen comprises a number of parallel rows of interleaved, shafted-mounted spaced disks. The spacing of the disks primarily determines the size of the chip that will fall through the disk screen. The majority of the material which remains atop the disk screen is overthick. The disk screen has been found to be particularly useful in sorting chips according to thickness. In a typical situation, the predetermined chip thickness range is 2 mm to 10 mm, and for hardwood chips 2 mm to 8 mm.

An improvement to Christensen's system is described in U.S. Pat. No. 4,376,042 to Brown, titled "Chip Sizing Process", which is assigned to the same assignee as the present invention. In the '042 patent, a two-deck gyratory screen forming a first screening station is used to produce three fractions. At least 30% to 60% of the total chip flow is screened at a second screening station, comprising a disk screen, resulting in efficient processing of the chip inflow and a reduction in the capital cost of the overall system. The invention also permits process changes to be accomplished in a simple manner and at a relatively low cost.

Both the Christensen publication and U.S. Pat. No. 4,376,042 are hereby incorporated by reference. However, the system of U.S. Pat. No. 4,376,042 did from time-to-time result in an overrun of the capability of the disk screen, and in those systems involving a retrofit, the total capital expense of the system was still relatively high. Hence, there is a continuing need in the chip sizing portion of the pulping process for improved efficiency and capital cost reduction.

DISCLOSURE OF THE INVENTION

Accordingly, the present invention is an apparatus and a method for sizing an incoming flow of chips into an output flow of chips which have a thickness dimension within a predetermined range. The apparatus includes means for directing the incoming wood chips to a first screening station which produces at least three wood chip "fractions", including a first fraction which comprises wood chips which are generally within a predetermined acceptable size range, a second fraction which comprises oversize chips together with chips within the acceptable size range and a third fraction which are all substantially oversize. The apparatus further includes a second screening station which receives only the second fraction of wood chips and produces a fourth fraction comprising chips which are generally within the predetermined acceptable size and a fifth fraction comprising chips which are all substantially oversize.

BEST MODE FOR CARRYING OUT THE INVENTION

Figure 2:
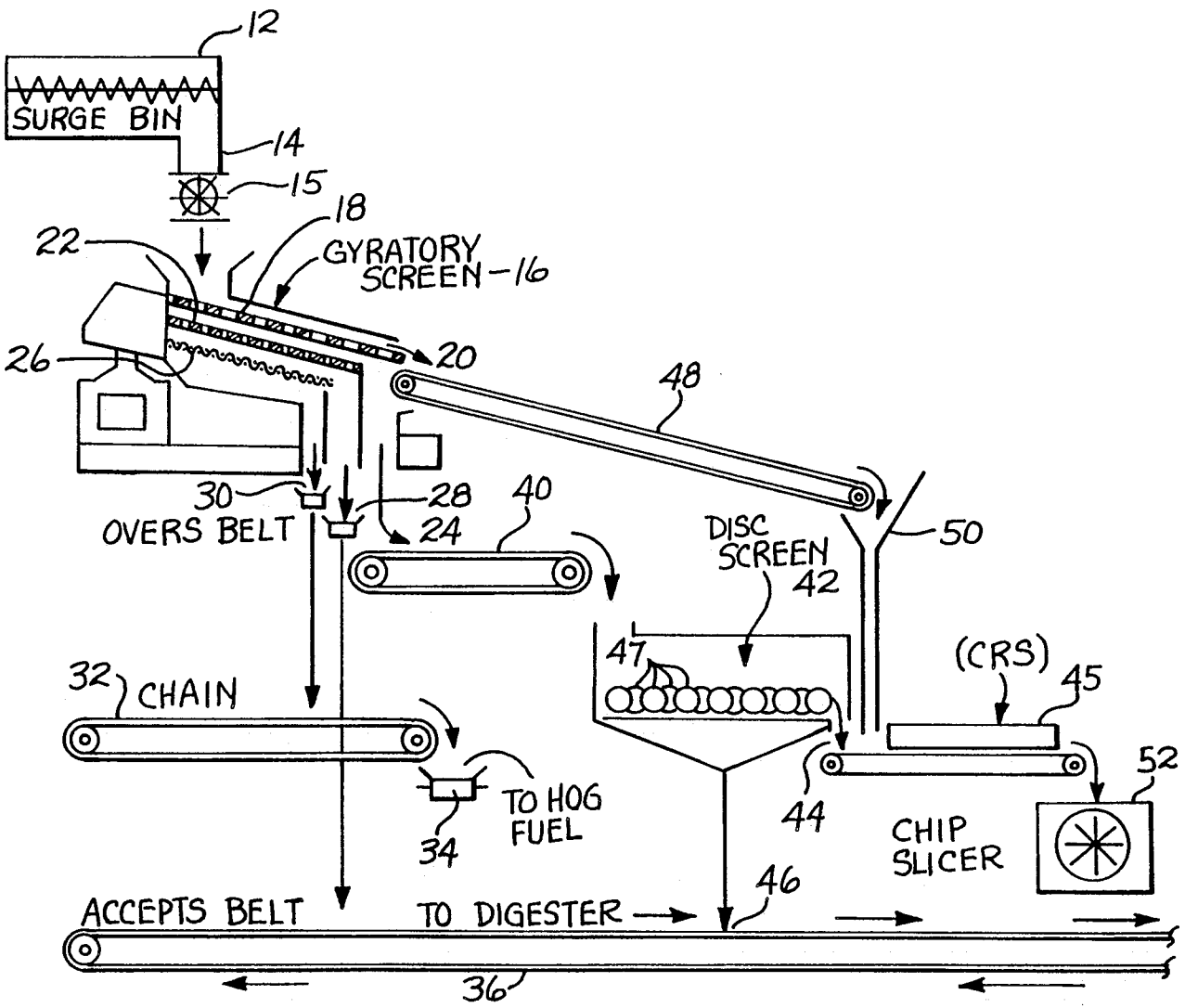
FIG. 2 is an elevational view of a complete sizing system incorporating the principles of the present invention.

FIG. 2 shows a complete chip sizing system, for use in a pulp processing system, which includes the particular screening arrangement of the present invention. An upstream source of wood chips (not shown) is typically moved by a conventional conveyor or the like (not shown) to a surge bin 12 having an outlet 14. From the outlet 14, the chips are moved by means of a metering device 15 to a gyratory screen system shown generally at 16. In the present invention, the gyratory screen 16 produces a total of four separate chip fractions. The top screen or deck 18 is a flat sheet member having openings which in the embodiment shown are circular, approximately 1¼" in diameter. The size and configuration of the openings could be varied, depending upon the particular application.

The chips which remain on top of screen 18 are substantially all overthick, are referred to as gyratory screen overs, and are designated as fraction 20. The chips falling through screen 18 encounter a second screen or deck 22. The openings in screen 22, which is also a sheet member, in the embodiment shown are ⅞" in diameter. The chips remaining on top of the second deck 22 are typically a mixture of chips which are within the acceptable predetermined thickness range (accepts) and overthick chips, and are designated as fraction 24. The chips falling through the second screen 22 encounter a third screen 26, which is typically a woven wire mesh. The chips on top of third screen 26 are substantially all accepts and are designated as fraction 28. The chips falling through third screen 26 are substantially all fines, are referred to as gyratory screen unders, and are designated as fraction 30.

The gyratory screen unders, i.e. fraction 30, which are substantially all fines, in the embodiment shown are directed to a horizontally-driven conveyor 32, which moves the unders to a receptacle 34. From there, the unders are moved to a location where they undergo further processing, such as to hog fuel, for instance.

Fraction 28, i.e. the accepts, are directed to a horizontal belt conveyor 36, which moves the accepts chips to a storage facility, such as a silo, or a pile, or directly to a conventional digester (not shown).

Fraction 24, the gyratory screen overs, a combination of accepts and overthick chips, is directed to a horizontal belt conveyor 40, which moves the material thereon to a conventional disk screen 42, as shown. The disk screen 42 accomplishes a second screening or fractionating function, based primarily on thickness of the chips. In operation, the material which remains on top of the disk screen 42 are essentially all overs, designated as fraction 44 and are moved to a contaminant removal system (CRS) 45. Typically, the CRS system will be an air density separator, for example. The chips which fall through the disk screen 42 are substantially all within the predetermined acceptable thickness range. These chips are designated as fraction 46 and are directed on to the accepts belt conveyor 36. The disk screen 42 is conventional, comprising a plurality of rotating disks 47—47 which are mounted on shafts (not shown), spaced apart a selected distance on said shafts, so as to pass chips having a thickness within the acceptable range. The disk screen 42 could be a flat disk screen or some other configuration. In a typical installation, a suitable disk spacing is 7 mm, with chips having a greater thickness dimension typically remaining on top of the screen 42.

Fraction 20, which comprises substantially all overthick chips, from the top of the first screen 18, is applied to a belt conveyor 48, which in the embodiment shown is angled downwardly from left to right. Substantially all of the chips in fraction 20 are overthick. The conveyor belt 48 bypasses the disk screen 42 and in the embodiment shown is located above the disk screen 42.

The chips on conveyor 48 are then directed to a vertical funnel-like member 50, which feeds these gyratory screen overs into CRS 45.

CRS 45 is well known in the art, such as an air density separator or a water flotation system, and is for the purpose of protecting the chip slicer 52 located downstream of CRS 45 from rocks and metals. An electromagnet might also be included with CRS 45 or located at some other point in the system to remove ferrous metals. The CRS unit 45 typically includes a cyclone in which the heavier elements, i.e. rocks, etc., are separated from the lighter chips and then removed. It should be understood, however, that various systems and devices may be used to accomplish this function of protecting the slicer.

The chips from CRS 45 are then directed to the chip slicer 52 which cuts or reduces the size of the chips so that they are substantially within the predetermined size range. The output of the chip slicer 52 is directed to belt 36 and from there to the digester or to storage.

Hence, with the apparatus of the present invention, all of the inflowing chips are processed and all the chips, with the exception of the fines, eventually move to the digester for pulping.

In the embodiment shown, approximately 25%–60% of the total incoming chip flow comprises fractions 20 and 24. Fraction 20 will typically be 5%–20% of the total flow while fraction 24 will be 20%–40% of the total flow. Some variance from these figures will occur in particular circumstances, including processing rate and feed material size distribution. The portion of fraction 24 which is overthick is substantially reduced relative to a gyratory system without the top screen or deck, which permits the use of a smaller disk screen, resulting in substantial cost savings. Disk screens are costly to manufacture and to repair and maintain. The smaller the disk screen, the greater the cost savings.

Figure 1:
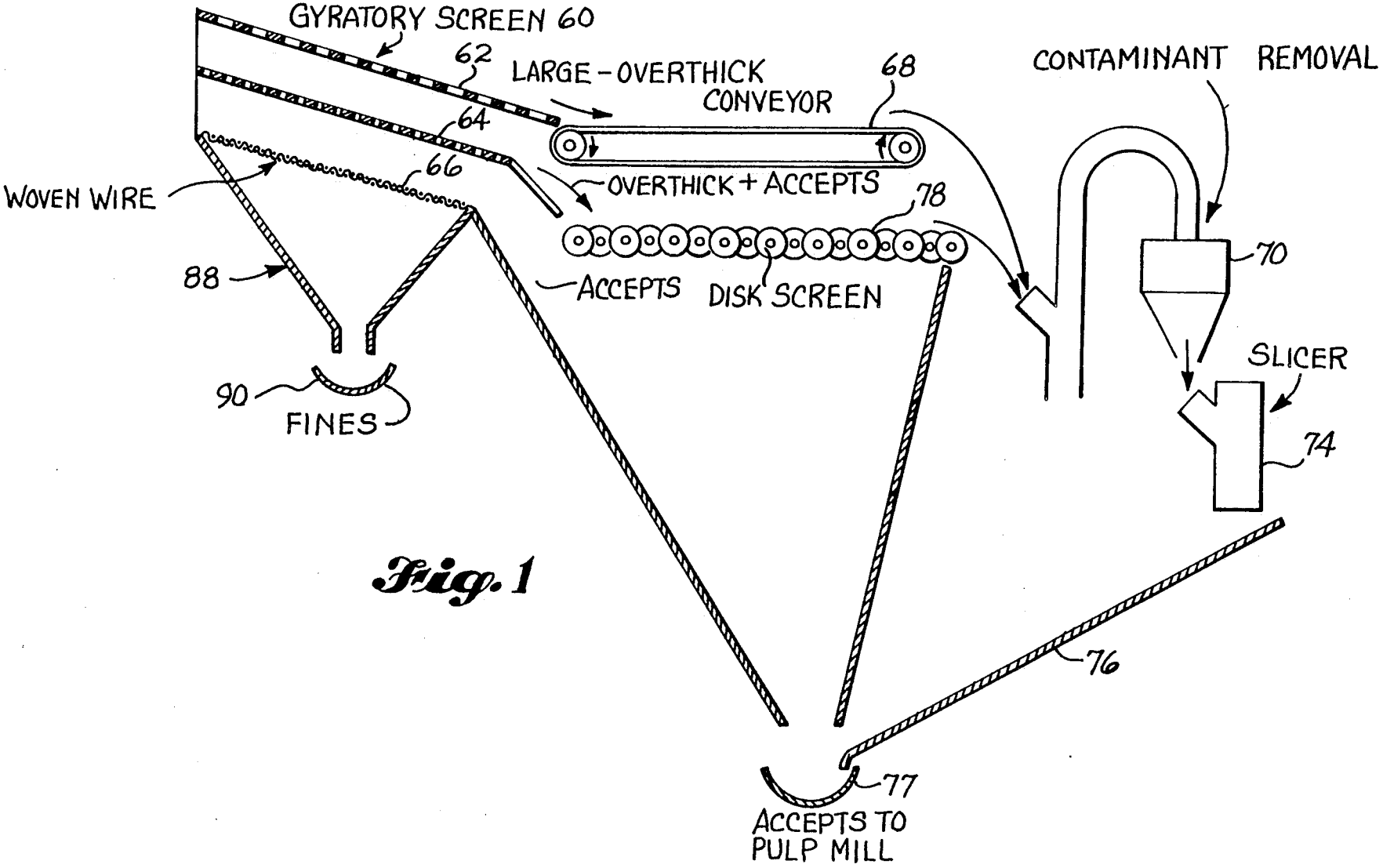
FIG. 1 is an elevational view of a simple embodiment of the sizing system of the present invention.

FIG. 1 shows the present invention in a slightly different configuration. Referring to FIG. 1, the gyratory screen system shown generally at 60 comprises a first screen 62, a second screen 64 and a third screen 66. The first and second screens are punched sheets while the third screen is typically of woven wire. The chips remaining on top of the first screen 62 after the gyrating action are substantially all overthick, and are applied to a conveyor 68, which moves the chips directly to a contaminate-removal system (CRS) 70 which may include a cyclone, and from there to a chip slicer 74. The chips which remain on top of the second screen 64 comprise both accepts and overthick chips. These chips are applied to a disk screen 78 and those chips which remain on the disk screen move to the CRS 70 and the slicer 74. The output of slicer 74 is moved along a downwardly inclined path from right to left in FIG. 1, by a chute 76 or the like to a conveyor 77. The chips falling through the disk screen 78 move into a funnel-like element 80 which extends downwardly to conveyor 77.

The chips remaining on top of the third screen 66 are substantially all accepts, i.e. within the predetermined acceptable range, and these are moved directly into the funnel-like element 80 and from there to the conveyor 77. Directly beneath the third screen 66 is a second funnel-like element 88 which receives the fines through the woven-wire screen 66. The fines move downwardly through the second funnel-like element 88 to a conveyor 90 which moves the fines to another location for further processing.

Figure 5:
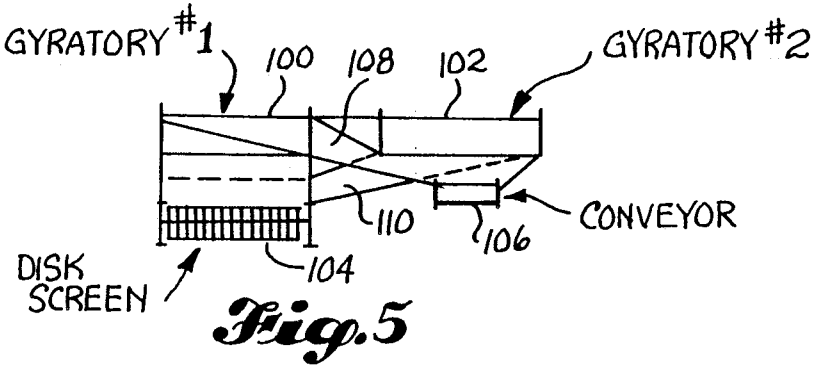
FIG. 5 is an end elevational view of the two-line system of FIGS. 3 and 4.
Figure 4:
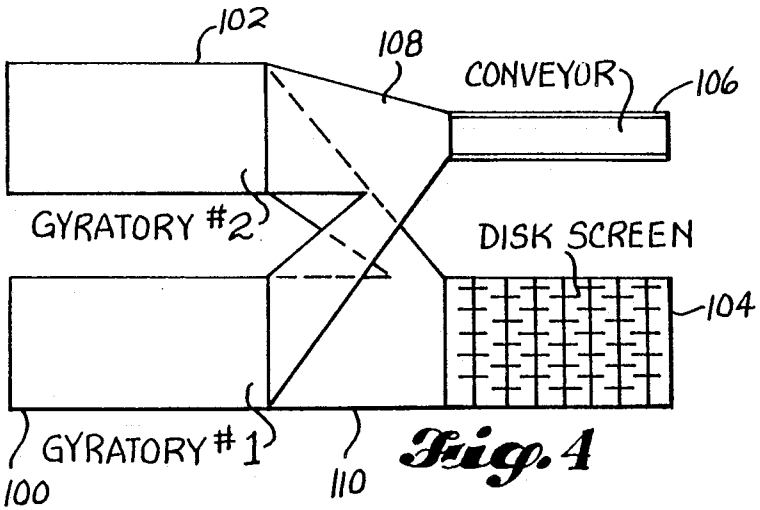
FIG. 4 is a top plan view of the two-line system of FIG. 3.
Figure 3:
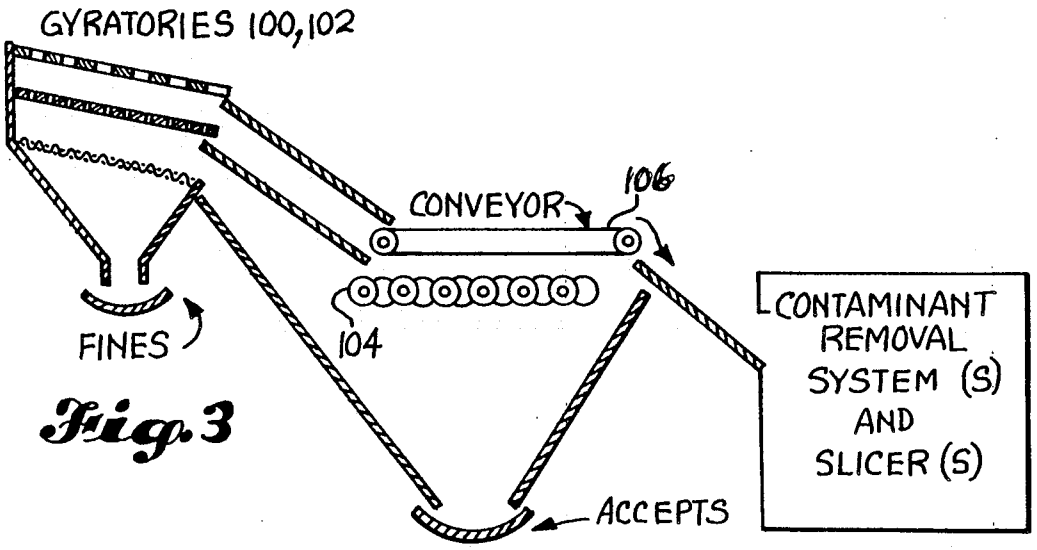
FIG. 3 is an elevational view of a two-line system incorporating the present invention and including only one disk screen.

FIGS. 3, 4, and 5 show a "two line" system comprising first and second gyratory screen systems 100 and 102. Gyratories 100 and 102 are each similar to the gyratories shown in FIGS. 1 and 2. However, instead of each gyratory having an associated separate disk screen and an elevated overthick chip conveyor, the system of FIGS. 3, 4, and 5 comprises one disk screen 104 and one elevated overthick chip conveyor 106 to service both gyratories. In this arrangement, the disk screen 104 and the conveyor 106 are spaced apart laterally, with the conveyor 106 being somewhat elevated relative to the disk screen 104, as shown most clearly in FIG. 5.

The two-line system includes two connecting chutes 108 and 110, a first chute 108 connecting the downstream end of both gyratories 100 and 102 to the upstream end of conveyor 106, while a second chute 110 connects the downstream end of both gyratories to the upstream end of the disk screen 104. This results in a significant capital cost savings for a two-line system, since the size of the disk screen can be significantly reduced. Also, such an arrangement permits the complete system to continue to operate at substantially total capacity in the event that the disk screen becomes inoperative. In such a situation, the material from the second screen in the gyratories can be applied directly to the accepts conveyor, while the material on top of the first screen is moved to the overthick chip conveyor as in normal operation. The entire flow of chips can thus be used, with the greatest overthick chips being treated, i.e. cut to proper size. The two-line system provides a greater overall capability than a single line and in the event one line is down, the other line can continue to run. Also, in the embodiment shown, the cost of a second disk screen is saved.

Figure 8:
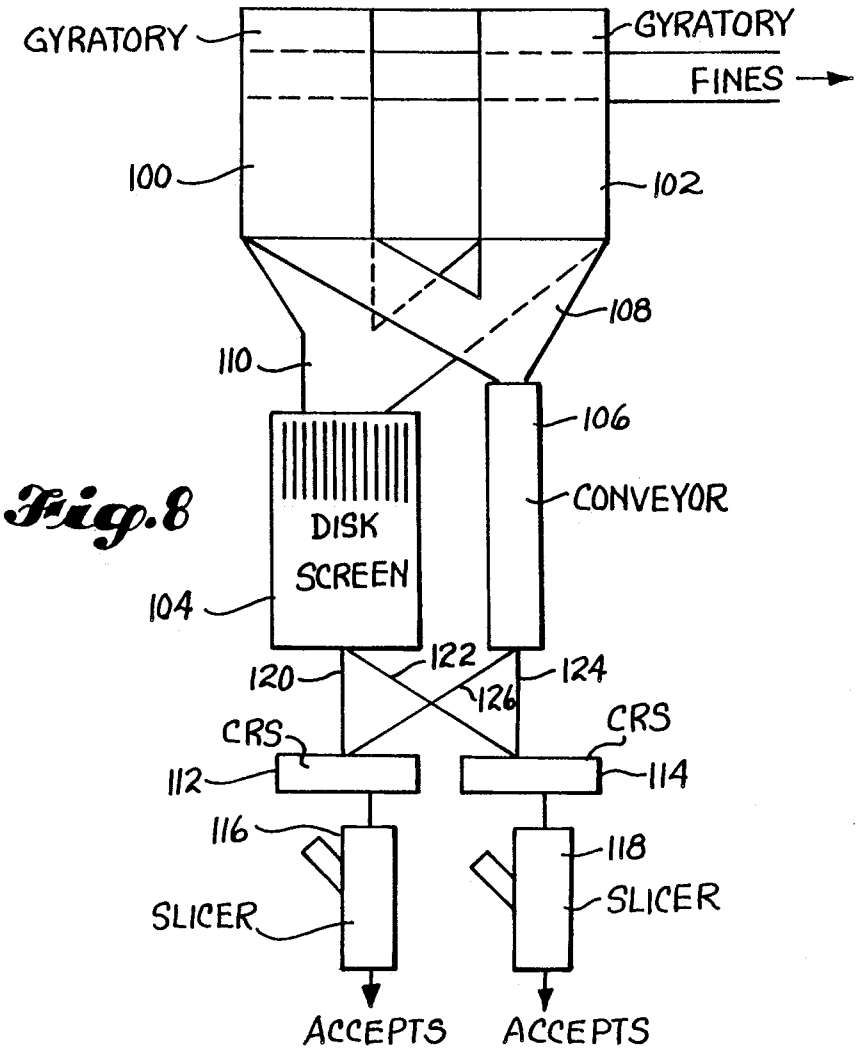
FIG. 8 is a top plan view of a complete two-line system of FIGS. 3, 4, and 5, showing a cross-feed arrangement for follow-on elements in the system.

FIG. 8 shows the system of FIGS. 3, 4, with the CRS systems and slicers shown in a cross-feed arrangement. Downstream of both the disk screen 104 and the conveyor 106 are CRS systems 112 and 114 and slicers 116 and 118. The system is constructed so that chips from the top of the disk screen 104 can be moved to either CRS system 112 or 114 through feed paths 120, 122, and from the conveyor 106 to either CRS system by feed paths 124, 126. Such a system is highly reliable, as at least one CRS and slicer line will almost always be operable.

Figure 7:
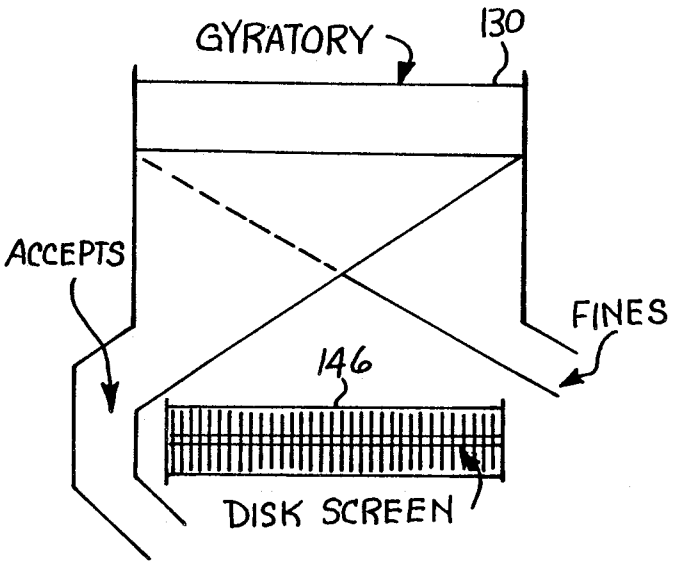
FIG. 7 is an end view of the stacked system embodiment of FIG. 6.
Figure 6:
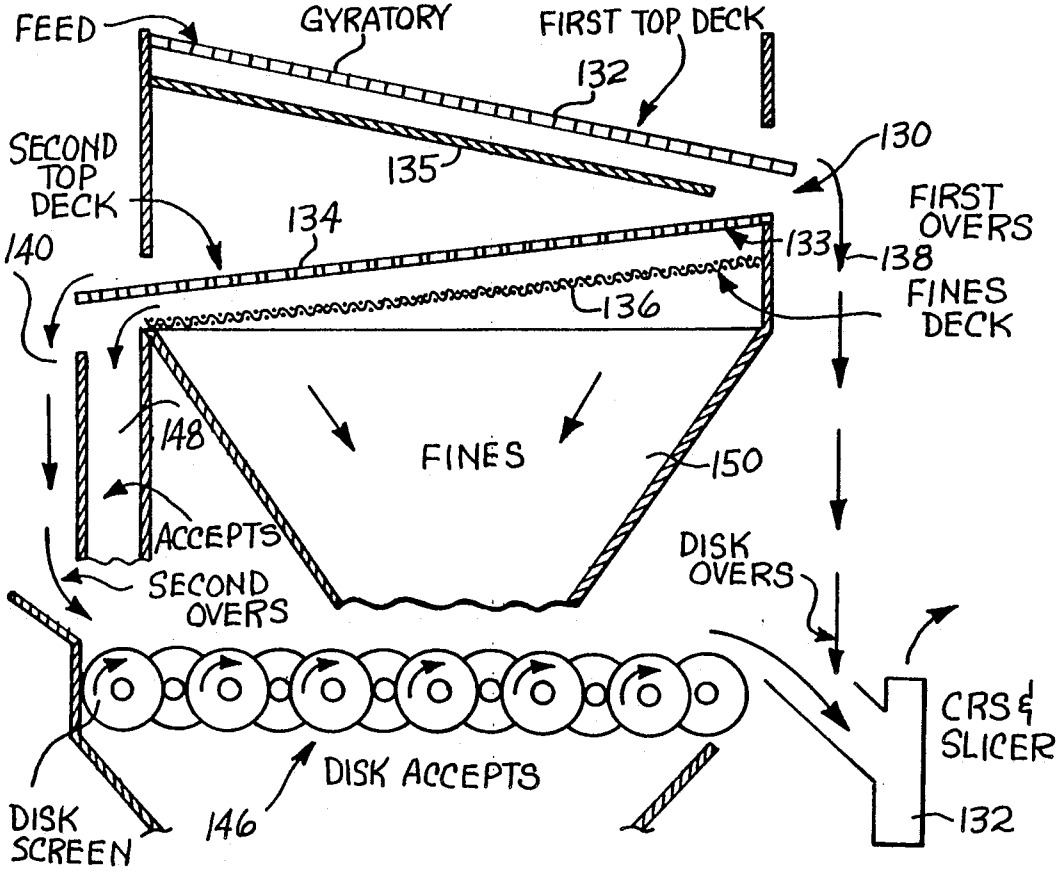
FIG. 6 is an elevational view of another embodiment of the present invention, in which the sizing system is in a stacked arrangement.

FIGS. 6 and 7 show a more compact, stacked arrangement of the chip sizing system of the present invention. In this embodiment, the gyratory system shown generally at 130 comprises three screens, similar individually to the three screens comprising the gyratories in the previously-described embodiments. However, the physical arrangement of the three screens is somewhat different. Instead of all three screens being parallel, separated by a selected distance, the first screen 132 slopes in one direction, from left to right in FIG. 6, while the second screen 134 therebeneath slopes from right to left. A pan-like element 135 is positioned beneath and parallel with screen 132, as shown. The third screen 136 is positioned parallel to the second screen and located a selected distance therebeneath.

In the arrangement shown, the chips which remain on top of the first screen 132, referred to in FIG. 6 as the first (large) overs, and designated as fraction 138, are directed to a vertical chute or drop directly into a CRS and slicer system 132, from where they are moved to a storage means or a digester (not shown). The chips falling through the first screen 132 encounter the solid plate or pan 135. The chips move down pan 135 to the upper end 133 of screen 134. The chips lying on top of the second screen 134, designated as fraction 140, are directed into a chute which is at the other side of the apparatus from fraction 138. These chips can either be considered to be all accceptable and moved to storage or the digester, or can be moved onto a conventional disk screen 146. Any overthick chips remain on top of the disk screen 146 and are moved to the CRS and slicer system, while the "accepts" fall through the disk screen 146 and on to a conveyor or the like (not shown) which moves them to storage or the digester.

The material falling through the second screen 134 encounters the third screen 136. The chips remaining on top of screen 136 are substantially all accepts, designated as fraction 148, and are directed to the conveyor referred to above with respect to the chips from disk screen 146.

The chips falling through the third screen 136 are the fines which move into the funnel element 150 and are carried away for further processing.

Thus, a chip sizing system has been described having an improved efficiency over existing systems. In this invention, a certain amount of the inflow of chips is initially fractioned out and routed by a conveyor directly to a CRS system and chip slicer, thereby bypassing the disk screen system. Such an arrangement decreases the amount of material to be processed by the disk screen, and improves the efficiency of the system. It permits a reduction in the size of the disk screen, and hence the cost of the system, and permits less expensive retrofit installations.

Although a preferred embodiment of the invention has been disclosed herein for illustration, it should be understood that various changes, modifications, and substitutions may be incorporated in such an embodiment without departing from the spirit of the invention as defined by the claims which follow.

I claim:

1. An apparatus for sizing incoming wood chips into an outflow of chips which have a thickness dimension within a predetermined range, comprising:

means directing the incoming wood chips to a first screening station which produces at least three fractions of wood chips, including a first fraction comprising wood chips which are generally within a predetermined acceptable thickness range, a second fraction comprising overthick chips together with chips within the acceptable thickness range, and a third fraction which are all substantially overthick;

a second screening station receiving only said second fraction of wood chips and producing a fourth fraction comprising chips which are generally within the predetermined acceptable thickness range and a fifth fraction comprising chips which are all substantially overthick;

a chip thickness reducing means, wherein the chip thickness reducing means produces a chip output which is substantially completely within the acceptable thickness range;

means directing said third fraction to said chip thickness reducing means, such that all of the chips in said third fraction bypass the second screening station and are not again directed to said first screening station; and means directing said fifth fraction to said chip thickness reducing means.

2. An apparatus of claim 1 wherein the first and second screening stations and the chip thickness reducing means are configured and arranged such that substantially all of the incoming chips are reduced in thickness to the predetermined acceptable thickness range.

3. An apparatus of claim 1, wherein the third fraction comprises approximately 5% to 20% of the total of the incoming chips.

4. An apparatus of claim 3, wherein the second and third fractions together comprise approximately 25% to 60% of the total of the incoming chips.

5. An apparatus of claim 1, wherein the chip thickness reducing means is a chip slicer which produces chips falling substantially within an acceptable thickness range.

6. An apparatus of claim 5, including means for removing rocks and metal from the third and fifth fractions, located upstream of the chip slicer.

7. An apparatus of claim 1, wherein the first screening station includes means for producing another fraction comprising chips which are smaller than the predetermined acceptable thickness range.

8. An apparatus of claim 1, including at least two substantially identical first screening stations, each said first screening station producing first, second, and third fractions, and wherein the apparatus includes means for directing the second fraction from each of the said first screening stations to a single second screening station and means directing the third fraction from each of said first screening stations to the chip thickness reducing means.

9. An apparatus of claim 1, wherein the first screening station includes a gyratory screen system comprising three screens, namely, an upper screen, an intermediate screen and a lower screen, positioned sequentially beneath each other, such that any chips remaining on top of the upper screen comprise the third fraction, any chips remaining on top of the intermediate screen comprise the second fraction, and any chips remaining on top of the lower screen comprise the first fraction, and wherein the second screening station is a chip screen.

10. A method for sizing incoming wood chips into an output flow of chips which have a thickness dimension within a predetermined range, comprising the steps of:

directing the incoming wood chips to a first screening station which produces at least three fractions of wood chips, wherein a first fraction comprises wood chips which are generally within a predetermined acceptable thickness range, a second fraction comprises overthick chips together with chips within the acceptable thickness range and a third fraction comprises substantially all overthick chips;

directing said second fraction to a second screening station which produces a fourth fraction comprising chips which are generally within the predetermined acceptable thickness range and a fifth fraction comprising chips which are all substantially overthick; and directing said third fraction and said fifth fraction to a chip thickness reducing means, such that all of said chips in the third fraction bypass the second screening station and are not directed again to said first screening station, wherein chips produced by the chip thickness reducing means are substantially all within the acceptable thickness range.

11. A method of claim 10, wherein the second fraction comprises approximately 5% to 20% of the incoming chips.

12. A method of claim 10, wherein the second and third fractions together comprise approximately 25% to 60% of the incoming chips.

13. A method of claim 10, wherein the first screening station includes at least two substantially identical first screening stations, and wherein the method includes the further step of directing the third fraction produced by each of the first screening stations to a single chip thickness reducing means and directing the second fraction produced by each of the first screening stations to a single secondary screening station.

* * * * *